United States Patent [19]

Lalancette

[11] 4,430,157

[45] Feb. 7, 1984

[54] CALCINED SERPENTINE AS INORGANIC CHARGE IN SHEET MATERIALS

[76] Inventor: Jean M. Lalancette, 470 Duvernay St., Sherbrooke, Quebec, Canada

[21] Appl. No.: 474,455

[22] Filed: Mar. 11, 1983

Related U.S. Application Data

[63] Continuation-in-part of Ser. No. 251,913, Apr. 7, 1981, abandoned.

[51] Int. Cl.[3] ..... D21H 5/18

[52] U.S. Cl. ..... 162/145; 162/3; 162/152; 162/181.6

[58] Field of Search ..... 162/3, 145, 181.1, 155, 162/181.6, 152; 423/167, 331

[56] References Cited

U.S. PATENT DOCUMENTS

| | | | |
|---|---|---|---|
| 2,210,892 | 8/1940 | Brandenberg | 423/167 |
| 2,384,008 | 9/1945 | Brandenberg | 423/167 |
| 3,014,835 | 12/1961 | Feigley et al. | 162/155 |
| 3,215,494 | 11/1965 | Hemstock | 423/167 |
| 3,725,196 | 4/1973 | Winters | 162/145 |
| 4,225,383 | 9/1980 | McReynolds | 162/146 |
| 4,277,596 | 7/1981 | Lalancette | 528/106 |
| 4,287,020 | 9/1981 | Moore | 162/3 |

FOREIGN PATENT DOCUMENTS

| | | | |
|---|---|---|---|
| 980065 | 1/1965 | United Kingdom | 423/167 |

*Primary Examiner*—Peter Chin

*Attorney, Agent, or Firm*—Cushman, Darby & Cushman

[57] ABSTRACT

There is provided an improved non-woven fibrous felt material made up of fibers, partially fibrous agglomerates of forsterite, enstatite and silica as filler and an organic binder. The improved felt material possesses increased hot tensile strength over felt material made from non-calcined asbestos tailings or inert inorganic fillers.

8 Claims, No Drawings

CALCINED SERPENTINE AS INORGANIC CHARGE IN SHEET MATERIALS

This application is a continuation-in-part of application Ser. No. 251,913 filed Apr. 7, 1981 and now abandoned.

The present invention relates to an improved non-woven fibrous base felt material and more particularly to an improved non-woven fibrous base felt incorporating forsterite-silica-enstatite aggregates as filler.

BACKGROUND OF THE INVENTION

It is known in the field of surface coating and particularly vinyl surface coverings to provide a non-woven fibrous substrate to receive the resinous wear-like layer. The fibrous support layer usually consists of either an organic fiber felt such as cellulose or polypropylene fiber or a mineral fiber felt such as asbestos fiber or glass fiber or a mixture of both and the felt is impregnated with a synthetic resin saturant or binder such as a synthetic rubber or latex.

Initially, the incorporation of 1–5% of asbestos fibers was made to improve the dimensional stability of the cellulose felt. Subsequently, it was found that the incorporation of higher levels of from 10 to 50% of asbestos markedly improved the dimensional stability of the felts over those incorporating only from 1–5%.

Other non-woven fibrous base felt material have been prepared by binding a mixture of cellulosic fibers and an inert inorganic filler or charge such as magnesium hydroxide, calcium carbonate, titanium oxide, talc, mica, clay, alumina, perlite and similar inert fillers. The selection of the filler or charge is based on its cost and its compatibility with the other ingredients used in the compounding of the non-woven fibrous base felt material.

As suggested by the above list, almost any inorganic insoluble material can be used. However, the performances are not the same with all the inorganic fillers, some giving more interesting behaviors than others depending on many factors such as the polarity of the surface, the specific surface, the hydrophillic or hydrophobic character and the like.

It is obvious that a filler that would incorporate fibers would be very advantageous since it would contribute to the overall strength of the end product.

The recovery of asbestos fiber from asbestos containing rocks is accompanied by the production of substantial amounts of finely divided rock, mostly serpentine (magnesium silicate: $3MgO.2SiO_2.2H_2O$) which are rejected in the course of the extraction of the fiber and is designated as tailings or residues. This serpentine incorporates a variable amount of chrysotile in the form or short fiber.

After investigating the properties of asbestos tailings, it has been found that such tailings have excellent properties as filler for the manufacture of sheets or non-woven boards. It has to be understood that these asbestos tailings which are available in very large amounts of the appropriate granulometry still contain substantial amounts of short asbestos fiber to an extent that can be as high as 20%. Therefore, since asbestos fiber is well known for its excellent properties as an agent for sheet formation, it is not surprising that these tailings so rich in fiber also give good performances as inorganic filler, in the course of the formation of the sheet.

Notwithstanding the technical advantages of fibrous base felts incorporating asbestos fibers, it is believed that asbestos and asbestos-containing products possess carcinogenic properties with the consequence that many industries have, in recent years, either discontinued manufacturing and selling products incorporating asbestos fibers or have attempted to replace the asbestos fibers contained in said products by other less objectionable fibers or fillers, such as fiberglass, carbon fiber and mineral fiber such as rock wool.

Accordingly, because of the low cost of asbestos tailings of residues, it would appear highly desirable to use such tailings or residues as inert fillers in the manufacture of non-woven fibrous base felt material if the inherent disadvantages resulting from the presence of asbestos in said tailings could be eliminated.

SUMMARY OF THE INVENTION

Essentially, the present invention provides a non-woven fibrous base felt material adapted to receive a resinous surface covering which comprises a homogeneous mixture of an organic fiber, a modified asbestos tailings or residues as filler and a synthetic resin binder.

Asbestos tailings or residues are modified to the purpose of this invention by calcining said asbestos tailings or residues to a temperature of from 800° to 1000° C., preferably between 900° to 1300° C., thereby to obtain a partially fibrous agglomerate devoid of asbestos fibers, free of magnesium oxide, not bonded to silica and containing crystalline forsterite as a main constituent, the remainder being amorphous silica or a mixture of silica and crystalline enstatite. Since the calcining operation destroys the fibrils of the asbestos tailings or residues as will be shown later, there is thus obtained a filler devoid of any asbestos fiber and thus devoid of any carcinogenic activity normally associated with asbestos fibers. Furthermore, the felt product of the present invention using calcined asbestos tailings or residues as inorganic filler is further characterized by a substantial increase in its hot tensile strength as compared to felt products containing non-calcined asbestos tailings or other inorganic inert fillers.

DETAILED DESCRIPTION OF THE INVENTION

More specifically, the non-woven fibrous base felt product of the present invention comprises a homogeneous mixture of organic fibers, calcined asbestos tailings or residues and a synthetic binder.

More specifically, the non-woven fibrous base felt product comprises a homogeneous mixture of from 2 to 40% by weight of fibrous material, 10 to 80% by weight of calcined asbestos tailings, partially fibrous agglomerates devoid of asbestos fibers, free of magnesium oxide, not bonded to silica, and containing forsterite as the main constituent, the remainder being silica or a mixture of silica and crystalline enstatite, at least 85% of which having a granulometry of between −60 to +400 mesh*, and 2 to 25% of a synthetic binder.

*All mesh sizes used herein are determined by the Tyler Standard Screen Scale

The fiber may be an organic fiber such as kraft fibers, polyester fibers, rag fibers or unbleached kraft pulp and the like or mixtures thereof, or fibers such as glass fibers. The corrugated kraft or liver-board kraft is preferred. The amount of fibers can vary between 2 to 40% by weight of the dry base felt with a range of from 10 to 25% by weight being preferred.

In accordance with the present invention, it has been found that the calcination of asbestos tailings produces partially fibrous agglomerates devoid of asbestos fibers, free of magnesium oxide, not bonded to silica, and containing forsterite as the main constituent, the remainder being silica or a mixture of silica and crystalline enstatite. Previous indications suggested the formation of free MgO from the heat treatment of tailings (U.S. Pat. No. 2,210,892, U.S. Pat. No. 2,384,008). More recent literature (Deutschen Keramischen Gesellschaft, 42, 373 (1965)) has established that the pattern of heat treatment of a magnesium silicate is the following.

The first reaction to take place is the production of forsterite, with liberation of silica. If the heat treatment is long enough or at sufficient temperature, the silica is reincorporated, at least in part, to give a mixture of forsterite, enstatite and silica, according to the following equations:

$$2Mg_3Si_2O_7 \xrightarrow{800^\circ\ C.} \underset{\text{Crystalline Forsterite}}{3\ Mg_2SiO_4} + \underset{\text{Amorphous Silica}}{SiO_2}$$

$$3Mg_2SiO_4 + SiO_2 \xrightarrow{1300^\circ\ C.} \underset{\text{Crystalline Forsterite}}{2Mg_2SiO_4} + \underset{\text{Crystalline Enstatite}}{2\ MgSiO_3}\ \underset{\text{Amorphous Silica in minute amounts}}{[SiO_2]}$$

These results of the scientific literature are confirmed by U.S. Pat. No. 3,215,494 where the formation of forsterite and other products by heat treatment of serpentine is clearly shown.

The composition of the mixture obtained by the calcination of asbestos tailings or residues is related to the calcination temperature and the duration of the calcination. For example, when calcining at a temperature of from 800°-900° C. for about 1 hour, the calcined mixture will consist of crystalline forsterite as the main constituent and the remainder will be amorphous silica. On the other hand, if the calcination step is carried out at a temperature of from 900°-1300° C. for about 1 hour, the amorphous silica formed between 700° and 900° C., is partially incorporated in part of the forsterite to provide the mixture containing mainly crystalline forsterite as the main constituent, the remainder being crystalline enstatite and amorphous silica. In all cases, calcining at temperatures between 800° and 1300° C. will destroy all the asbestos fibers as can be observed by the complete disappearance of asbestos fibers by transmission electron microscopy at a magnification sufficient to detect fibers at 1.0 nm (nanometer) in length.

The material after heat treatment has been examined by transmission electron microscopy, using selected area electron diffraction and energy dispersive X-ray analysis to establish the absence of chrysotile and the nature of existing species. The complete absence of chrysotile fibers was noted. But, surprisingly, the material was not amorphous and retained a partial fibrous structure in the form of agglomerates 50-100 nm in diameter, thus explaining its particularly good performances on a filler. Therefore, this technique of analysis has established that the calcination has transformed the starting material into an aggregate of fibrous material, no longer magnesium silicate or asbestos but made of forsterite, enstatite and silica, in accordance with the cited literature. The maintenance of fibrous structure was quite unexpected since calcination is accompanied by a 13% weight loss that might very well have shattered any fibrous structure.

In our calcination procedure, we recommend a heat treatment over a substantial period of time, of the order of one hour, in order to make absolutely certain that all traces of asbestos fibers have been eliminated, although shorter time at high temperature has been found adequate.

It has been noted that calcined asbestos tailings having a fine granulometry of from −60 to +400 mesh, with a preferred granulometry of about −200 mesh being preferred can be used instead of asbestos fibers or instead of inorganic inert fillers. This can be explained by the substantial fibrous character of these calcined tailings as indicated above. Furthermore, it has also been found that by calcining the asbestos tailings at a temperature of from 800° to 1300° C., preferably at between 900° to 1200° C., the asbestos tailings are modified to a point where they surprisingly lose their carcinogenic properties, most likely because of the important structural modifications sustained by the tailings in the course of the thermal treatment. The amount of calcined asbestos tailings in felt varies within the range of from 10 to 80% by weight, with a range of 6 to 70% by weight being preferred.

As resin binder, there is used an organic binder such as a synthetic rubber latex or any well known synthetic polymer latex or binder presently used in the manufacture of asbestos fiber or asbestos/cellulosic fiber sheet or fiberglass sheet material such as, for example, rubbery polymer containing carboxyl or functionally equivalent groups such as a butadiene-styrene-itaconicacid terpolymer; a latex polymer containing styrene, butadiene and methacrylic acid or methacrylamide or maleic acid; and other similar rubbery polymers which are well known in the art of manufacturing asbestos fiber felts. The amount of resin binder will vary between 2 to 25% by weight with a range of from 5 to 10% by weight being preferred.

The process for preparing the non-woven fibrous base felt of the present invention comprises preparing a fibrous slurry of the organic fiber in water of about from 0.1 to 5.0% consistency. To this slurry is added aqueous slurry of 1 to 2% calcined asbestos tailings. There is then added a latex system containing from about 30 to 40% latex and the mixture is processed as is known in the art of sheet making, for example, on a Foudrinier paper machine. If desired, there is added from 0.1 to 0.2% of a flocculant such as, for example, Dow® SD 30440-01 flocculant.

The present invention will be more readily understood by referring to the following examples which are given only to illustrate the invention rather than limit its scope.

EXAMPLE I

In a one gallon battery jar were added 360 ml of tap water at 20° C. and 1000 ml of a 1.2% slurry of corrugated fibers made from Kraft corrugated cardboard and water. The slurry was agitated for 30 seconds at 600 rpm. Then was added 34 g of calcined tailings, −200 to +325 mesh, calcined at 900° C. for one hour. Under very slow stirring was added 3.25 g of latex (Dow® XD 30374-02) and 0.05 g of the flocculant (Dow® XD 30440-01).

The suspension was then filtered on a Williams® sheet forming apparatus which is essentially a box with a screen at the bottom, for filtration.

The resulting sheet was dried between blotting papers and then on an Emerson sheet dryer.

EXAMPLES II–III

The procedure of Example I was repeated except that in one case the calcined asbestos tailings were replaced by the same amount of untreated asbestos tailings having a mesh size of from −200 to +325 mesh, and, in another case, by calcium carbonate also having a mesh size of from −200 to +325 mesh.

Sheets measuring 8×9 inches of each example were prepared, their density was measured and each was tested for its hot tensile strength and Examples I and II were tested for their asbestos fiber content by the abrasion test and results are reported in Table I.

TABLE I

| Ex. | Filler | Caliber (inch) | Weight 9" × 8" gm | Density lb/ft$^3$ | Hot Tensile Lb/in (PSI) | Asbestos Fiber per c.c. |
|---|---|---|---|---|---|---|
| I | Calcined asbestos tailings | 0.032 | 24.27 | 39.63 | 11.3 (350) | 0 |
| II | Asbestos tailings | 0.032 | 22.88 | 37.83 | 8.4 (268) | >2 |
| III | Calcium carbonate | 0.0274 | 26.82 | 51.79 | 5.9 (200) | — |

It will be readily observed that calcined asbestos tailings provide an increase of 30% in hot tensile strength of the felt prepared therefrom as compared with untreated asbestos tailings and an increase of 75% over felt prepared with calcium carbonate as inert filler. It will also be noted that the calcination step of asbestos tailings has completely eliminated the presence of asbestos fibers.

I claim:

1. An improved non-woven fibrous base felt which comprises a solid homogeneous sheet of a mixture of from about 2% to about 40% by weight of fibrous material, from about 10% to about 80% of the partially fibrous agglomerates devoid of asbestos fibers, free of magnesium oxide not bonded to silica and containing crystalline forsterite as the main constituent, the remainder being amorphous silica or a mixture of crystalline enstatite and amorphous silica obtained by calcination of asbestos tailings, at least 85% of which having a granulometry of between −60 to about +400 mesh and from about 2% to about 25% by weight of an organic binder, said felt being characterized by the total absence of asbestos fibers coming from the agglomerate.

2. A base felt as in claim 1, where the heat treatment applied to asbestos tailings was sufficient to insure the complete disappearance of chrysotile as shown by transmission electron microscopy at a magnification sufficient to detect fibers 1.0 nm in length.

3. An improved non-woven fibrous base felt which comprises a solid homogeneous sheet of a mixture of about 10 to 25% by weight of fibers with a majority of organic fibers, about 60 to 70% by weight of partially fibrous agglomerates devoid of asbestos fibers, free of magnesium oxide not bonded to silica and containing crystalline forsterite as the main constituent, the remainder being amorphous silica or a mixture of crystalline enstatite and amorphous silica obtained by calcination of asbestos tailings, at least 85% of which having a granulometry of between −60 to about +400 mesh and about 5 to 10% by weight of latex, said felt being characterized by the total absence of asbestos fibers coming from the agglomerate.

4. A method of making an improved non-woven fibrous base felt which comprises mixing an aqueous slurry of fibers having a consistency of from 0.10 to 5.0% with an aqueous slurry of asbestos tailings having been calcined at a temperature of from 800° to 1300° C., to form partially fibrous agglomerates devoid of asbestos fibers, free of magnesium oxide not bonded to silica and containing crystalline forsterite as the main constituent, the remainder being amorphous silica or a mixture of crystalline enstatite and amorphous silica, adding to said mixture an organic binder, forming a felt from said slurry mixture and drying said felt.

5. A method as in claim 4 wherein the calcining temperature range is from 800° to 900° C.

6. A method as in claim 4 wherein the calcining temperature range is from 900° to 1200° C.

7. A method as in claim 4 where the heat treatment has been such as to reincorporate at least part of the liberated silica at the formation of forsterite to generate enstatite.

8. A method of making an improved non-woven fibrous base felt which is free of asbestos fibers which comprises mixing in the presence of water from 2 to 40% by weight of a fibrous material with from 10 to 80% by weight of asbestos tailings, at least 85% of which having a granulometry of between −60 to about +400 mesh, said asbestos tailings having been calcined at a temperature of from 800° to 1300° C., to form partially fibrous agglomerates adding to said mixture from 2 to 25% by weight of an organic binder, forming a felt from the thus obtained slurry mixture and drying said felt.

* * * * *